US007692124B2

(12) United States Patent
Lee

(10) Patent No.: US 7,692,124 B2
(45) Date of Patent: Apr. 6, 2010

(54) AIR FLOW PASSAGE OF MICROWAVE OVEN

(75) Inventor: Duck Gil Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 86 days.

(21) Appl. No.: 10/575,856

(22) PCT Filed: Oct. 15, 2004

(86) PCT No.: PCT/KR2004/002631

§ 371 (c)(1),
(2), (4) Date: Dec. 18, 2006

(87) PCT Pub. No.: WO2005/038354

PCT Pub. Date: Apr. 28, 2005

(65) Prior Publication Data

US 2007/0194013 A1 Aug. 23, 2007

(30) Foreign Application Priority Data

Oct. 16, 2003 (KR) ..... 10-2003-0072118

(51) Int. Cl.
*H05B 6/64* (2006.01)
*H05B 6/80* (2006.01)

(52) U.S. Cl. ..... 219/757; 219/682

(58) Field of Classification Search ..... 219/757, 219/756, 681, 751, 762, 763, 400; 126/21 A, 126/21 R, 299 R, 299 D
See application file for complete search history.

(56) References Cited

U.S. PATENT DOCUMENTS 4,424,430 A * 1/1984 Almgren et al. ..... 219/749
5,525,782 A * 6/1996 Yoneno et al. ..... 219/682
5,798,505 A 8/1998 Lee ..... 219/681

FOREIGN PATENT DOCUMENTS

CN 1085321 4/1994

(Continued)

OTHER PUBLICATIONS

Chinese Office Action dated Dec. 7, 2007.

(Continued)

*Primary Examiner*—Quang T Van
(74) *Attorney, Agent, or Firm*—KED & Associates, LLP

(57) ABSTRACT

Provided is an air flow passage of a microwave oven including: a cavity for accommodating foods therein; an electric component chamber disposed at a predetermined portion of the cavity; a suction hole formed at one sided portion of the cavity such that the cavity communicates with the electric component chamber; an exhaust hole formed at the other sided portion of the cavity, through which air sucked through the suction hole is exhausted; an exhaust guide covering an outer wall of the cavity where the exhaust hole is formed, for guiding air exhausted through the exhaust hole to an outside of the microwave oven; and a back plate having an exhaust passage hole communicating with one end of the exhaust guide, through which air is exhausted. According to the present invention, hot air of an inside of the microwave oven can be smoothly exhausted. In particular, since the exhausted air does not return to the electric component chamber, cooling efficiency can be enhanced.

24 Claims, 6 Drawing Sheets

FOREIGN PATENT DOCUMENTS

| | | | | |
|---|---|---|---|---|
| CN | 1230663 | | 10/1999 | |
| JP | 62-297634 | * | 12/1987 | ..... 219/757 |
| JP | 07-151334 | | 6/1995 | |
| KR | 1995-0019971 | | 7/1995 | |
| KR | 1995-0033879 | | 12/1995 | |
| KR | 1998-0018316 | | 7/1998 | |

OTHER PUBLICATIONS

Australian Search Report dated Aug. 14, 2008.
Australian Patent Office Examiner's report dated Jul. 2, 2007.

* cited by examiner

AIR FLOW PASSAGE OF MICROWAVE OVEN

TECHNICAL FIELD

The present invention relates to a microwave oven, and more particularly, to an air flow passage of a microwave oven that enables hot air of foods or electric components to be properly exhausted to an outside of the microwave oven. Further, the present invention relates to an air flow passage of a microwave oven that enables smooth exhaust of air flowing between a ceramic plate disposed at a lower side of a cavity and a bottom of the cavity and prevents the air to flow back toward an electric component chamber.

BACKGROUND ART

A microwave oven is a cooking device that cooks food by passing microwave through the food, and uses a magnetron to generate the microwave from a supplied electric current.

Such a microwave oven is classified into a household microwave oven having a small magnetron and a commercial microwave oven having a large magnetron or a plurality of magnetrons. The microwave oven is further classified according to a heating method into a glass tray method rotating the food loaded on the glass tray and a stirrer fan method scattering radiated microwave into the cavity. The former is generally applied to the household microwave oven while the latter is applied to the commercial microwave oven. Since the commercial microwave oven is generally used at convenience stores where the microwave oven is frequently used or restaurants where a large amount of the food should be quickly heated, the commercial microwave oven needs relatively high power output compared with the household microwave oven. Due to the use of the high power, in the commercial microwave oven, a lot of heat is generated compared with the household microwave oven. Accordingly, in the commercial microwave oven, it is essentially required to exhaust the generated heat.

In the meanwhile, a great amount of heat is generated during the operation of the microwave oven. In other words, heat is first generated from the electric component chamber during the operation of the transformer and the magnetron, and heat is also generated from food heated by a microwave radiated to an inside of the cavity. If the heats are not properly exhausted to an outside, there is caused a problem that electric components of the electric component chamber do not operation normally. Also, since the inner temperature of the cavity is elevated to a very high temperature, the inner components of the cavity may be damaged or a user may be burned.

To solve the aforementioned heat radiation problem, a blower fan is installed in the electric component chamber. The air blown from the blower fan cools inner components of the electric component chamber and is then introduced into an inside of the cavity through one surface of the cavity. The air introduced into the inside of the cavity absorbs inner hot air of the cavity, is exhausted through another surface of the cavity, and then exhausted to an outside of the microwave oven.

However, when the hot air of the cavity is not exhausted properly, the hot air flows back to the inside of the electric component chamber. That is, when the hot air inside the cavity flows back to the inside of the electric component chamber through an interval between components prior to being exhausted to the outside of the microwave oven, there may be caused a phenomenon that the inner components of the electric component chamber are heated. At this time, since the air transferred to the electric component chamber contains inner heat of the cavity, the inner temperature of the electric component chamber is further elevated.

Thus, if the electric component chamber is heated, the transformer and the magnetron may operate abnormally, which can be readily presumed.

Also, when hot air of the inside of the cavity is not properly exhausted to the outside of the microwave oven, the microwave oven is spontaneously heated, so that a user may be burned and coating may be damaged.

DISCLOSURE

Technical Problem

Accordingly, the present invention is directed to an air flow passage of a microwave oven that substantially obviates one or more of the problems due to limitations and disadvantages of the related art.

An object of the present invention is to provide an air flow passage of a microwave oven that can smoothly exhaust hot air of an inside of a cavity to an outside of the microwave oven.

Another object of the present invention is to provide an air flow passage of a microwave oven that can prevent hot air of an inside of a cavity from flowing backward to allow stable operation of inner devices of the microwave oven.

A further object of the present invention is to provide an air flow passage of a microwave oven that can sufficiently radiate heat of the microwave oven to permit a stable operation of devices, prevent a user from being burned, and extend the life span of the microwave oven.

Technical Solution

To achieve these and other advantages and in accordance with the purpose of the present invention, as embodied and broadly described, there is provided an air flow passage of a microwave oven including: a cavity for accommodating foods therein; an electric component chamber disposed at a predetermined portion of the cavity; a suction hole formed at one sided portion of the cavity such that the cavity communicates with the electric component chamber; an exhaust hole formed at the other sided portion of the cavity, through which air sucked through the suction hole is exhausted; an exhaust guide covering an outer wall of the cavity where the exhaust hole is formed, for guiding air exhausted through the exhaust hole to an outside of the microwave oven; and a back plate having an exhaust passage hole communicating with one end of the exhaust guide, through which air is exhausted.

Another aspect of the present invention, there is provided an air flow passage of a microwave oven including: a suction hole formed between a plate on which foods are placed and a cavity, through which air of an electric component chamber is introduced; an exhaust hole through which air introduced through the suction hole is exhausted; an exhaust guide for guiding air exhausted through the exhaust hole to an outside of the microwave oven; and a back plate having an exhaust passage hole for exhausting the air guided by the exhaust guide to an outside of the microwave oven.

Further another aspect of the present invention, there is provided an air flow passage of a microwave oven including: an exhaust hole formed perforating a wall surface of one side of a cavity, through which an inner air of the cavity is exhausted; an exhaust guide covering the exhaust hole and guiding air exhausted through the exhaust hole to an outside of the microwave oven; and a plate having an exhaust passage hole communicating with an inside of the exhaust guide and forming an outer wall of one side of the microwave oven.

Advantageous Effects

According to the present invention, hot air generated during an operation of the microwave oven can be properly radiated. Thus, since the generated hot air can be sufficiently exhausted, life span of the microwave oven is extended, safety of a user is improved, and stability of operation in the microwave oven is enhanced.

BEST MODE FOR CARRYING OUT THE INVENTION

Hereinafter, preferred embodiments of the present invention will be described in detail with reference to accompanying drawings.

Figure 1:
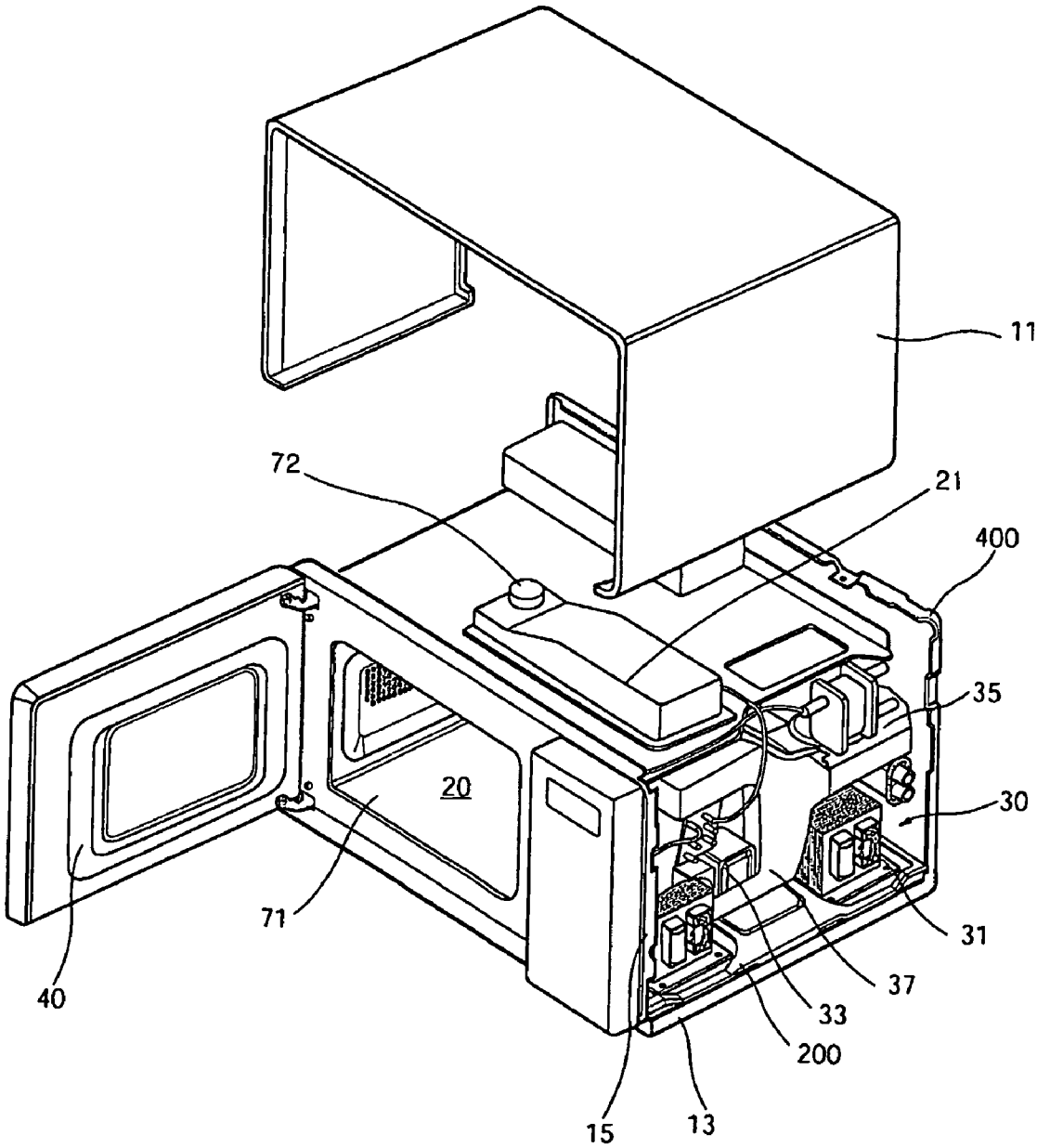
FIG. 1 is an exploded perspective view of a microwave oven according to the present invention.

FIG. 1 is an exploded perspective view of a microwave oven according to the present invention.

Referring to FIG. 1, a microwave oven includes an outer case forming the exterior of the microwave oven, a cavity 20 in which food is loaded, an electric component chamber 30 in which electric components are mounted, and a door 40 for selectively opening and closing a front of the cavity 20.

In detail, the outer case forms the exterior of the microwave oven and protects the cavity 20 as well. Therefore, the outer case is generally made of an iron plate having a desired strength. The outer case is installed centering on the cavity 20, and includes an upper plate 11 covering a top and both sides of the cavity 20 together, a base plate 13 protecting a bottom of the cavity 20, a front plate 15 forming the front of the cavity 20, and a back plate 17 protecting a back of the cavity 20.

The cavity 20, in which food is to be loaded for cooking, has a box-like shape with a front opening. Therefore, the food is loaded through the opening for cooking and is unloaded after the cooking through the opening. The cavity 20 is closely fixed to an upper surface of a sub-plate 200 to be described later. In particular, a ceramic plate 71 is disposed at a bottom of the cavity 20 so that a bottom surface of the cavity 20 is partitioned. Further, a stirrer fan (see 50 of FIG. 2) is disposed below the ceramic plate 71 to dispersedly radiate microwave.

The electric component chamber 30 is a space formed at an inner right side of the outer case to accommodate a plurality of electric components for the radiation of microwave. In the electric component chamber 30, electric components such as a transformer 31, a magnetron 33 for generating microwave, a blower fan 35 blowing cool air to the transformer 31 and the magnetron 33, etc., are mounted. Also, an exhaust duct 37 for exhausting inner air of the electric component chamber 30 to an outside of the microwave oven is mounted in the electric component chamber 30. The lower surface of the electric component chamber 30 is supported by the sub-plate 200.

While the aforementioned electric components, in particular, the transformer 31 and the magnetron 33 function to generate microwave to be radiated to an inside of the cavity 20, they generate high temperature heat during their operation. To this end, so as to cool the heated electric component chamber 30, it is necessary to suck ambient air using the blower fan 35. Some of the air blown by the blower fan 35 is introduced into the cavity 20.

Figure 2:
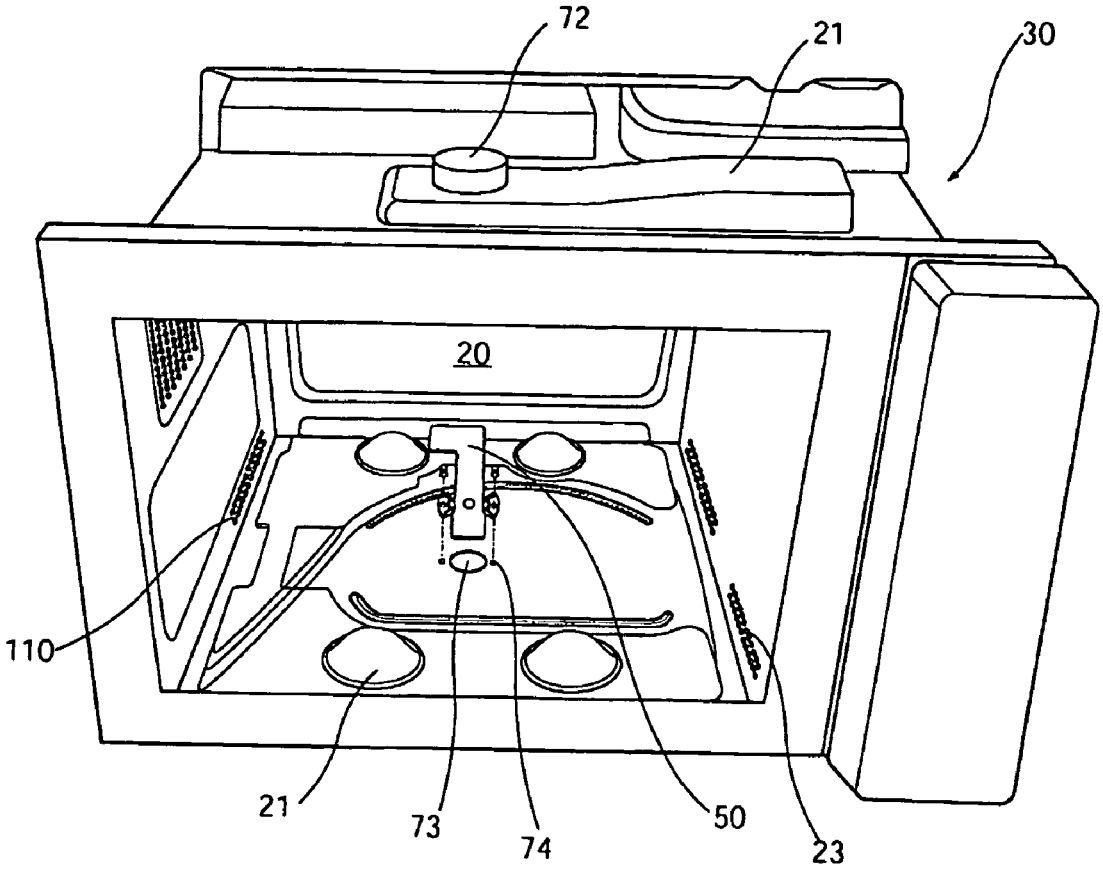
FIG. 2 is a front perspective view of a microwave oven according to a spirit of the present invention.

FIG. 2 is a front perspective view of a microwave oven according to a spirit of the present invention. A construction of the cavity 20 will now be described with reference to FIG. 2.

Referring to FIG. 2, a waveguide 21 is mounted on an upper side, more accurately, on an outer upper surface of the cavity 20. The waveguide 21 guides the microwave generated by the magnetron 31 toward an inside of the cavity 20. A motor 72 for driving the stirrer fan is mounted on an output terminal of the waveguide 21 to rotate the stirrer fan.

The waveguide 21 is mounted on an outer lower surface of the cavity 20 as well as on the outer upper surface of the cavity 20. Thus, by mounting the waveguide 21 on the outer upper surface and the outer lower surface of the cavity 20, the microwaves radiated toward the inside of the cavity 20 are guided from an upper direction to a lower direction, and from the lower direction to the upper direction so that the food loaded in the cavity 20 is cooked three-dimensionally.

The ceramic plate (see 71 of FIG. 1) is installed at an inner bottom of the cavity 20 to form a substantial lower surface of the cavity 20, but is omitted in FIG. 2. In other words, the bottom of the cavity is shown in FIG. 2 without the ceramic plate. Also, it can be easily understood that a predetermined space is formed below the ceramic plate 71 for air flow. In detail, the ceramic plate 71 is mounted spaced apart by a predetermined height from the bottom of the cavity 20, which becomes possible by supporting protrusions 21 protruded upwardly from the bottom of the cavity 20. Food is loaded on the upper surface of the ceramic plate 71.

Thus, a predetermined space is formed between the bottom of the cavity 20 and the ceramic plate 71, and the stirrer fan 50 is installed at the space between the bottom of the cavity 20 and the ceramic plate 71. A perforated communication hole 73 is formed at a bottom of the cavity 20 so as to connect the stirrer fan 50 to the motor. A pair of fixing holes 74 for fixing the stirrer fan 50 are formed at right and left of the communication hole 73.

The stirrer fan 50 is rotated by a motor (not shown) installed at an outer lower surface of the cavity 20, to scatter the microwave radiated from the waveguide 21 toward an inside of the cavity 20 such that the microwave is radiated to an overall inner space of the cavity 20.

In the meanwhile, a plurality of perforated suction holes 23 are formed at right lower wall portions of the cavity and a plurality of perforated exhaust holes 110 are formed at a left lower wall portion of the cavity 20. The suction holes 23 are configured to communicate an inner space of the electric component chamber 30 with an inside of the cavity 20, and the exhaust holes 110 are configured to communicate with a space between the cavity 20 and the left wall of the upper plate (see 11 of FIG. 1). Accordingly, air of the electric component chamber 30 introduced through the suction holes 23 is exhausted through the exhaust holes 110. Besides the air of the electric component chamber 30, hot air generated from foods loaded in the cavity 20 and hot air generated from the stirrer fan 50 are also smoothly exhausted through the exhaust holes 110 to an outside of the cavity 20.

Next, passage structure and operation of air exhausted through the exhaust holes 110 will be described with reference to the accompanying drawings.

Figure 3:
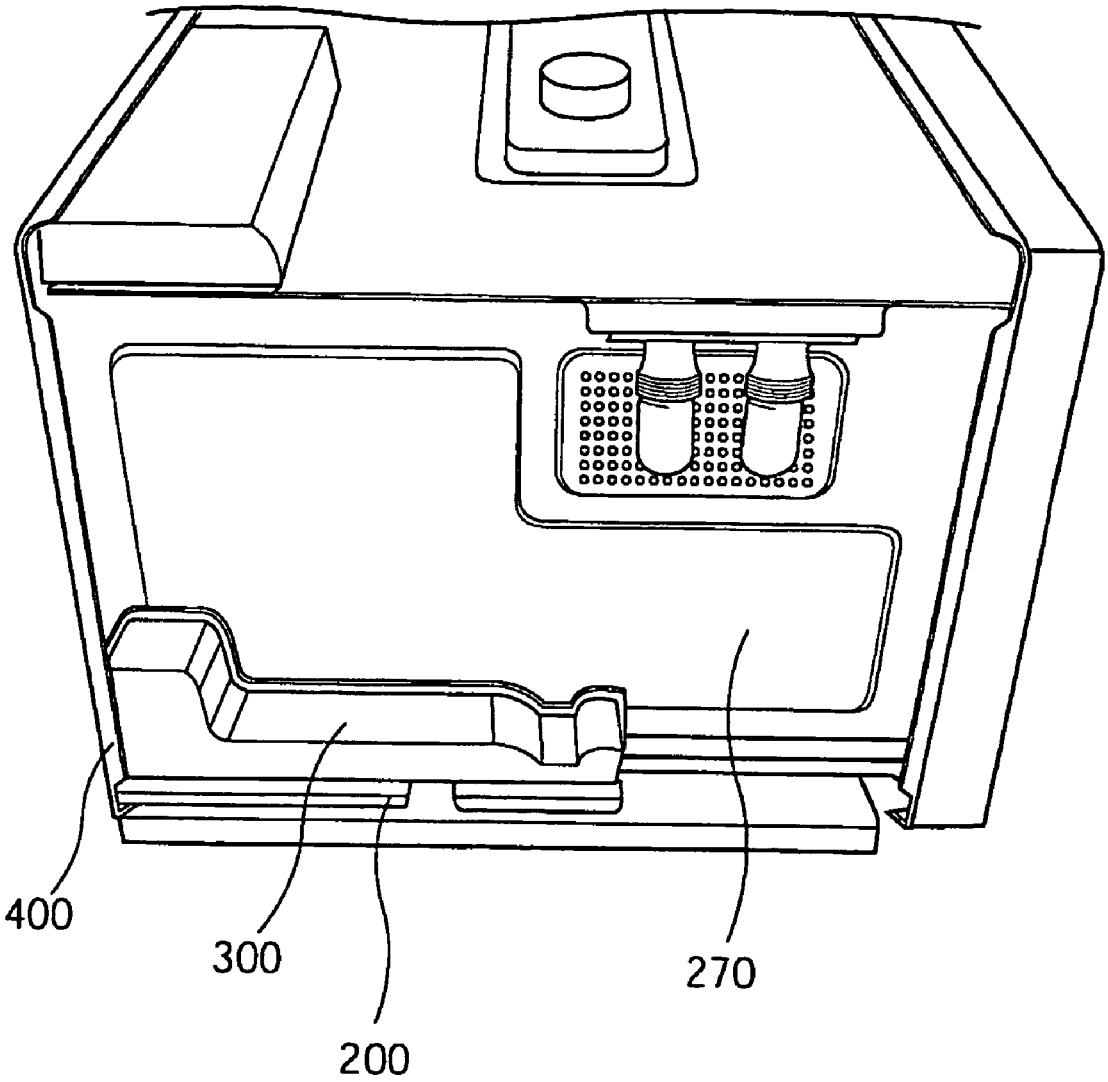
FIG. 3 is a left perspective view of a microwave oven according to the present invention.
Figure 4:
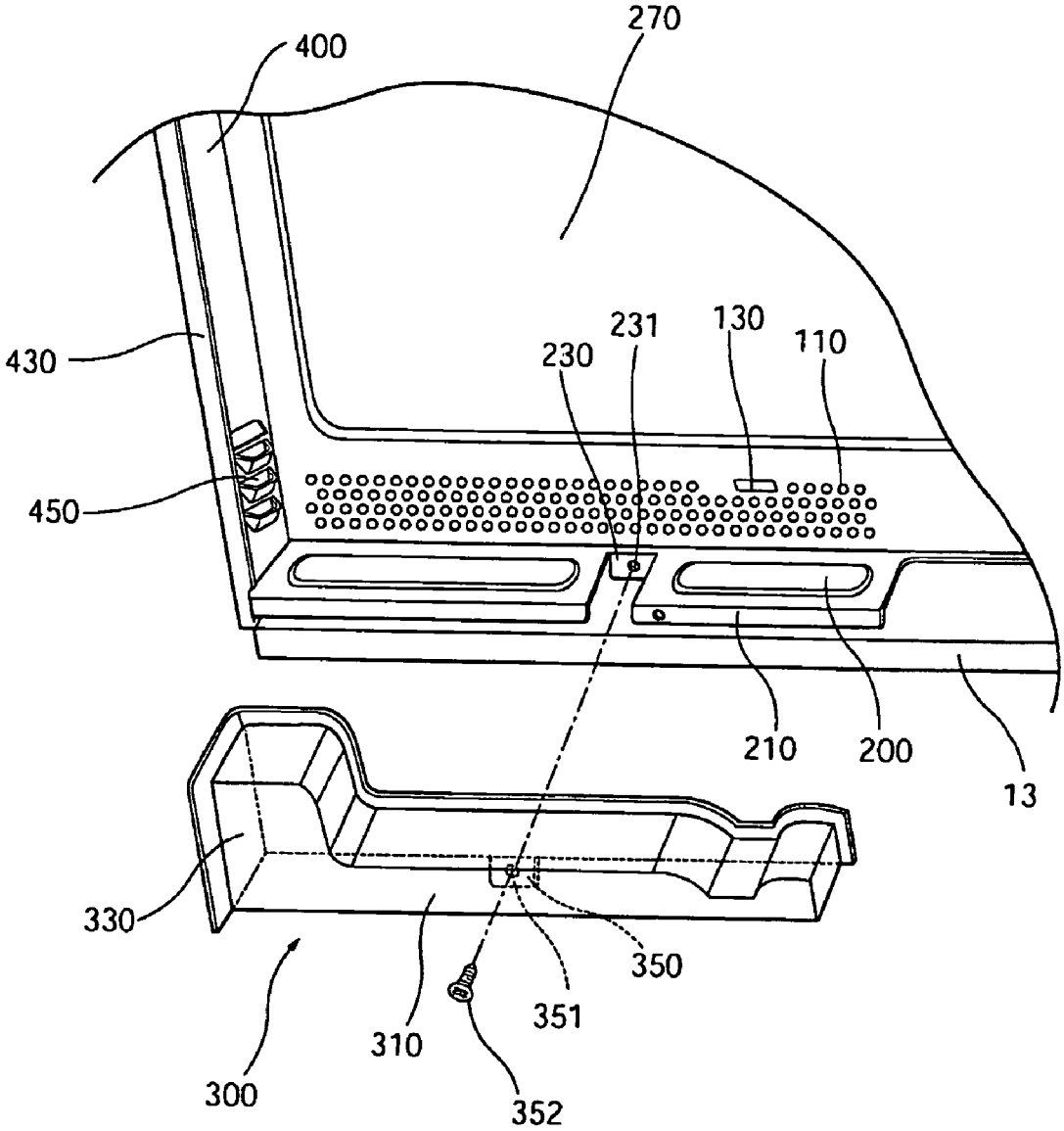
FIG. 4 is a partial perspective view of a microwave oven showing a separation of an exhaust guide.

FIG. 3 is a left perspective view of a microwave oven according to the present invention, and FIG. 4 is a partial perspective view of a microwave oven showing a separation of an exhaust guide.

Referring to FIGS. 3 and 4, the plurality of exhaust holes 110 are formed at the left lower wall portion of the cavity 20 such that the inner space of the cavity 20 communicates with an outside. It can be easily understood that the inner air of the cavity 20 is exhausted through the exhaust holes 110. A perforated shaking preventing hole 130 through which a shaking preventing protrusion (see 370 of FIG. 5) is inserted is formed at an upper right portion of the exhaust holes 110.

A lower wall plate of the cavity 20 is mounted on an upper surface of the sub-plate 200 installed apart by a predetermined distance from the base plate 13. A front side of the sub-plate 200 is fixed to a rear surface of the front plate 15, and a rear side of the sub-plate 200 is fixed to a front surface of a back plate 400.

Also, the sub-plate 200 has a bent portion 210 formed at a side edge thereof and bent downwardly from an upper surface of the sub-plate 200. The bent portion 210 has a holder 230 formed at one edge thereof and to which a predetermined portion of the exhaust guide 300 is fixed. The holder 230 also has a coupling hole 231. The holder 230 is coupled with the exhaust guide 300 by a fixing rib 350 after the holder 230 is placed parallel to the left wall 270 of the cavity 20 and the exhaust guide 300 is arranged close to the holder 230.

Also, if the exhaust guide 300 is fixed to an outer surface of the left wall of the cavity 20, a predetermined space is formed between the left wall 270 of the cavity 20 and the exhaust guide 300. It can be easily understood that the air exhausted through the exhaust holes 110 is collected through the predetermined space and then exhausted.

Figure 5:
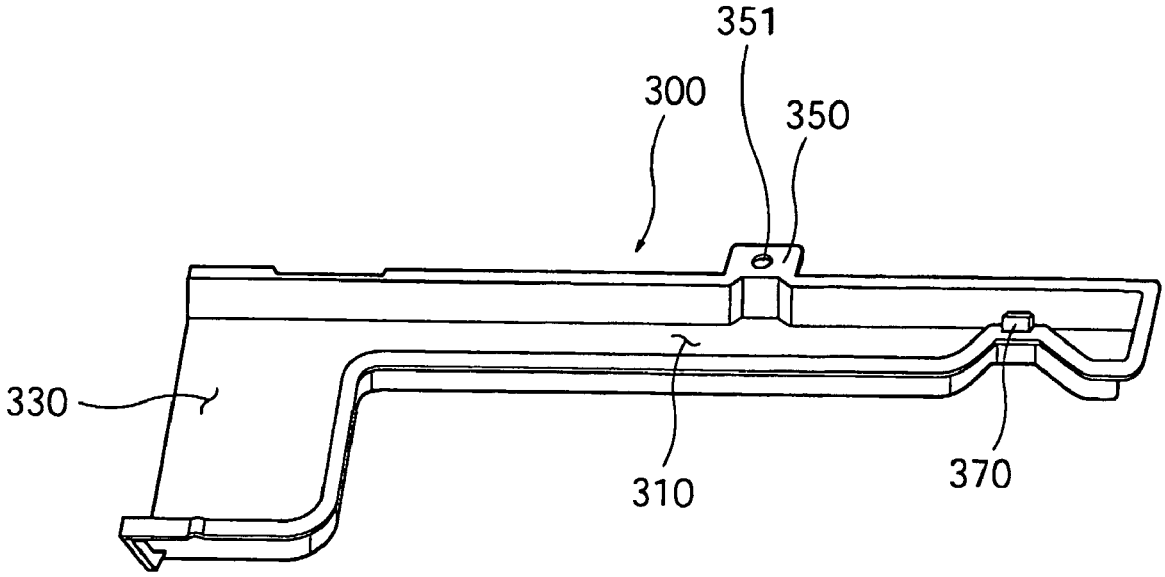
FIG. 5 is a perspective view of an exhaust guide of a microwave oven according to the present invention.

In the meanwhile, as aforementioned, the exhaust guide 300 is installed in front of the exhaust holes 110 and can be apparently understood from the perspective view of the exhaust guide 300 shown in FIG. 5.

Referring to FIG. 5, the exhaust guide 300 includes a guide portion 310 and an outlet portion 330. In detail, the guide portion 310 functions to open a front of the plurality of exhaust holes 110 and to initially collect the air exhausted through the exhaust holes 110. The outlet portion 330 has a relatively larger volume and width than the guide portion 310 to exhaust the air guided through the guide portion 310 to a rear of the microwave oven, in more detail, to a direction of exhaust passage holes 450.

The exhaust guide 300 has a fixing rib 350 formed at a middle lower portion of the guide portion 310. The exhaust guide 300 is fixed to an outer surface of the exhaust holes 110 by the fixing rib 350. The fixing rib 350 has a perforated hole 351 through which a coupling means, for example, a screw 352, is screwed. The exhaust guide 300 is closely in contact with the holder 230 of the sub-plate 200 and is then coupled to the outer surface of the left wall 270 of the cavity 20 by the screw 352 screwed after the perforated hole 351 is aligned with the coupling hole 231.

Also, the exhaust guide 300 has the shaking preventing protrusion 370 formed at an edge of a rear of the exhaust guide 300 and inserted into the shaking preventing hole 130 of the cavity 20. The shaking preventing protrusion 370 is formed corresponding to the shaking preventing hole 130 to prevent the exhaust guide 300 from shaking when the exhaust guide 300 is fixed to the left wall 270 of the cavity 20.

Figure 6:
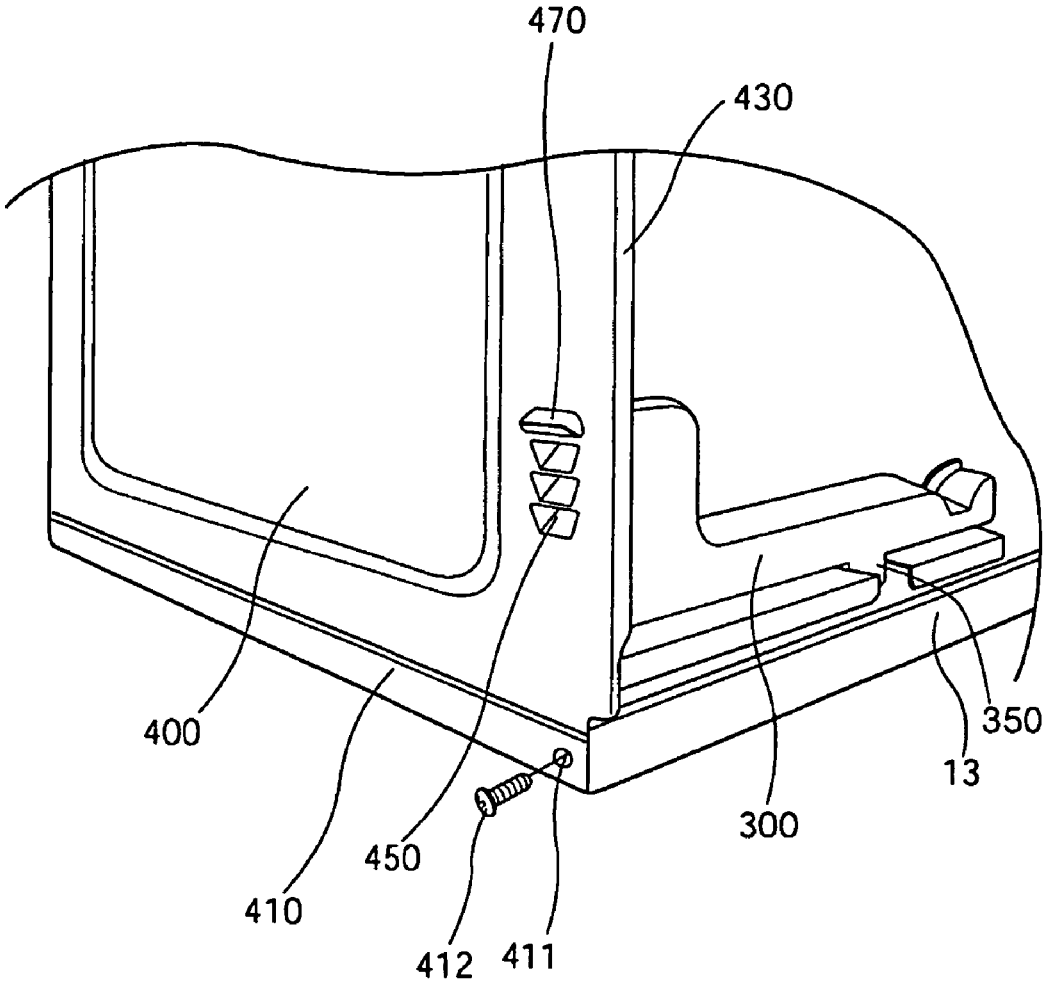
FIG. 6 is a rear perspective view of a microwave oven according to the present invention.

In the meanwhile, the back plate 400 is installed at the rear side of the cavity 20. Construction and installation of the back plate 400 can be readily understood from the rear perspective view of the microwave oven shown in FIG. 6.

The back plate 400 functions to protect the rear side of the cavity 20 and to form the exterior of the microwave oven. For these functions, the back plate 400 is generally made of an iron plate having a predetermined strength.

A connection bar 410 is formed at a lower end of the back plate 400 and is fixed to a rear surface of the base plate 13. The connection bar 410 has at least one coupling hole 411 formed at a predetermined portion thereof. By screwing the screw 412 to the coupling hole 411, the back plate 400 is firmly fixed to the rear side of the base plate 13.

Also, the back plate 400 has a bent portion 430 formed in a vertical direction and bent forwardly from a side end line. Although not shown in the drawings, an inner wall surface of the upper plate is closely in contact with the bent portion 430. The plurality of exhaust passage holes 450 are formed at a left portion of the back plate 400, more accurately, at a portion aligned with an end of the exhaust guide 300. The exhaust passage holes 450 are formed with an upward inclination, which is for preventing water flowing down along the back plate 400 from being introduced into an inside of the exhaust guide 300 through the exhaust passage hole 450.

Also, a water permeation preventing guide 470 is formed above the exhaust passage hole 450 to guide water flowing down in the direction of the exhaust passage hole 450 due to its weight to an outside of the exhaust passage hole 450 such that the water does not flow into the inside of the exhaust passage hole.

Next, construction of the exhaust guide 300 installed at the left wall 270 of the cavity 20, i.e., in front of the exhaust hole 110, will be described with reference to FIG. 4.

The exhaust guide 300 held by a hand or a tool is transferred such that its rear surface is closely contacted with the left wall 270 of the cavity 20. At this time, the fixing rib 350 of the exhaust guide 300 is accurately aligned with the holder 230 of the left wall 270 of the cavity 20. Of course, the perforated hole 351 of the fixing rib 350 communicates with the coupling hole 231 of the holder 230. Also, when the exhaust guide 300 is closely in contact with the outer surface of the left wall 270 of the cavity 20, the shaking preventing protrusion 370 protruded toward the inside of the exhaust guide 300 is inserted into the shaking preventing hole 130 of the left wall 270 of the cavity 20. Thus, as the shaking preventing protrusion 370 is inserted into the shaking preventing hole 130, though vibration is generated, the exhaust guide 300 can be prevented from shaking.

After that, as the screw 352 is screwed to the perforated hole 351 and the coupling hole 231, the exhaust guide 300 is firmly fixed to the outer surface of the left wall 270 of the cavity 20.

Hereinafter, air flow passage related with the state of when the exhaust guide 300 is installed at the outer wall surface of the cavity 20 will be described.

The ceramic plate 71 is installed on a bottom of the cavity 20. A predetermined interval portion is formed between the ceramic plate 71 and the bottom of the cavity 20. The perforated suction holes 23 are formed at the lower portion of the right wall of the cavity 20, and the perforated exhaust holes 110 are formed at the lower portion of the left wall of the cavity 20.

In this state, air is introduced into the interval portion between the ceramic plate 71 and the bottom of the cavity 20 from the inside of the electric component chamber 30 through the suction holes 23, and the introduced air absorbs hot air around the stirrer fan 50 while passing through the stirrer fan 50 rotating inside the interval portion, and is then exhausted to an outside through the exhaust holes 110. At this time, hot air generated from the cavity 20 during a cooking is also exhausted together with the hot air exhausted through the exhaust holes 110.

After that, the air exhausted through the exhaust holes 110 is collected at the inner space of the exhaust guide 300 installed at an outer side of the exhaust holes 110 spaced apart from the exhaust holes 110, and is then exhausted to a rear side of the microwave oven. In detail, the air exhausted through the exhaust holes 110 is collected at the inner space of the guide portion 310, and is then exhausted to a rear side of the microwave oven through the outlet portion 330 and the exhaust passage hole 450. For the air to be smoothly exhausted through the exhaust passage hole 450, the outlet portion 330 is formed having a larger width than the guide portion 310.

In another aspect of the present invention, the air guided by the exhaust guide 300 and then exhausted to the outside of the cavity 20 is collected at an outer circumferential surface of the left wall 270 of the cavity 20 and an inside of a space partitioned by the inner surfaces of the back plate 400. In detail, the air exhausted through the exhaust holes 110 is initially collected at the inside of the guide portion 310 and is then transferred to the outlet portion 330. The inner air of the exhaust portion 330 is exhausted to an outside of the microwave oven through the exhaust passage hole 450. Thus, by guiding hot air to the outside of the microwave oven through a closed space and air passage, the hot air in the microwave oven is smoothly exhausted to the outside and does not flow back to the inside of the electric component chamber.

Thus, since the air exhausted through the exhaust holes 110 is smoothly exhausted to the outside of the microwave oven, it can be prevented that the air flows back to the inside of the electric component chamber and thereby electric components are again heated.

INDUSTRIAL APPLICABILITY

According to the air flow passage provided in the present invention, hot air in a microwave oven is rapidly exhausted to an outside of the microwave oven without a leakage and is prevented from flowing back to the electric component chamber along an outer surface of the cavity or through an interval between the cavity and other components. By doing so, since the inner components of the electric component chamber are not heated by hot air exhausted through the exhaust holes, there is an advantage that the inner components operate stably.

Also, since the electric components operate stably, safety in the use of the microwave oven and left span are improved.

Further, since the exhaust passage hole has an inclination and a water permeation preventing guide formed thereabove, there is an advantage that water flowing down along the back plate can be prevented from being introduced into an inside of the microwave oven.

The invention claimed is:

1. A microwave oven with an air flow passage, the microwave oven, comprising:

a cavity that accommodates food therein;

an electric component chamber disposed at a predetermined portion of the cavity for accommodating a plurality of electric components for radiation of microwave;

a suction hole formed at one sided portion of the cavity such that the cavity communicates with the electric component chamber;

an exhaust hole formed at the other sided portion of the cavity, through which air sucked through the suction hole is exhausted;

an exhaust guide covering an outer wall of the cavity where the exhaust hole is formed, that guides air exhausted through the exhaust hole to an outside of the microwave oven; and a back plate having an exhaust passage hole communicating with one end of the exhaust guide, through which air is exhausted, wherein the suction hole and the exhaust hole are formed at an interval portion between a bottom plate of the cavity and a plate on which the food is loaded, and the air introduced through the suction hole and exhausted through the exhaust hole flows below the food loaded on the plate by a fan for cooling the electric components.

2. The microwave oven according to claim 1, wherein the exhaust guide forms a predetermined space at a portion between the exhaust guide and an outer surface of a sidewall of the cavity.

3. The microwave oven according to claim 1, wherein the exhaust guide has at least two portions that are different in width.

4. The microwave oven according to claim 1, wherein the exhaust guide comprises:

a guide portion having a width that is narrow such that the air exhausted through the exhaust hole is first concentrated; and an exhaust portion having a width that is wider than the guide portion such that the air is exhausted to an outside, wherein the width of the exhaust guide is varied gradually from the guide portion to the exhaust portion.

5. The microwave oven according to claim 1, wherein the exhaust guide is separatable from the microwave oven and is fixed to an outer circumference of the cavity.

6. The microwave oven according to claim 1, further comprising:

a shaking preventing protrusion formed at a predetermined portion of an edge of the exhaust guide; and a shaking preventing hole formed at an outer surface of the cavity, into which the shaking preventing protrusion is inserted.

7. The microwave oven according to claim 1, wherein the exhaust passage hole inclines downwardly toward the outside.

8. The microwave oven according to claim 1, further comprising a water permeation preventing portion formed at an upper portion of the exhaust passage hole, that prevents water from permeating into an inside of the microwave oven.

9. The microwave oven according to claim 1, wherein the exhaust guide is screwed to a sub-plate formed at a bottom of the cavity.

10. The microwave oven according to claim 1, further comprising a stirrer fan disposed at a connection passage of the suction hole and the exhaust hole.

11. The microwave oven according to claim 1, wherein the suction hole and the exhaust hole are formed at a lower side portion of the cavity.

12. An air flow passage for a microwave oven, comprising:

a cavity that accommodates foods therein;

a plate disposed at a bottom of the cavity, and food is placed on the plate;

a suction hole formed between the plate and the cavity, through which air of an electric component chamber is introduced;

an exhaust hole through which air introduced through the suction hole is exhausted;

an exhaust guide that guides air exhausted through the exhaust hole to an outside of the microwave oven; and a back plate having an exhaust passage hole that exhausts the air guided by the exhaust guide to an outside of the microwave oven, wherein the suction hole and the exhaust hole are formed between the bottom of the cavity and the plate on which the food is loaded, and the air introduced through the suction hole and exhausted through the exhaust hole flows below the food loaded on the plate by a fan for cooling a plurality of electric components for radiating microwave into the electric chamber.

13. The air flow passage according to claim 12, wherein the exhaust guide is fixed by a fixing terminal and a fixing portion that protrudes from the exhaust guide, the fixing terminal being formed at one sided portion of a sub-plate that supports a lower surface of the cavity.

14. The air flow passage according to claim 12, further comprising:

a shaking preventing protrusion formed at a predetermined portion of an edge of the exhaust guide; and a shaking preventing hole formed at an outer surface of the cavity, into which the shaking preventing protrusion is inserted.

15. The air flow passage according to claim 12, wherein the exhaust passage hole is formed penetrating the back plate.

16. The air flow passage according to claim 15, further comprising a water permeation preventing guide formed at an upper side of the exhaust passage hole.

17. A microwave oven, comprising:

a cavity that accommodates food therein;

an electric component chamber disposed adjacent a predetermined portion of the cavity;

at least one suction hole formed at one side portion of the cavity such that the cavity communicates with the electric component chamber;

at least one exhaust hole formed in another side portion of the cavity, through which air sucked through the suction hole is exhausted;

an exhaust guide that covers an outer wall of the cavity where the at least one exhaust hole is formed, that guides air exhausted through the at least one exhaust hole to an outside of the microwave oven; and a back plate having at least one exhaust passage hole that communicates with one end of the exhaust guide, through which air is exhausted, wherein the exhaust guide comprises:

a first portion having a width that is narrow such that the air exhausted through the at least one exhaust hole is first concentrated; and a second portion having a width that is wider than the first portion such that the air is exhausted to the outside through the at least one exhaust passage hole formed in the back plate, wherein the at least one suction hole and the at least one exhaust hole are formed in an interval portion between a bottom plate of the cavity and a plate on which the food is loaded, and the air introduced through the at least one suction hole and exhausted through the at least one exhaust hole flows below the food loaded on the plate by a fan for cooling a plurality of electric components for radiating microwave into the electric component chamber.

18. The microwave oven according to claim 17, wherein the exhaust guide forms a predetermined space between the exhaust guide and an outer surface of a sidewall of the cavity.

19. The microwave oven according to claim 17, further comprising:

a shaking preventing device provided at a predetermined portion on the exhaust guide and the cavity, respectively, to prevent the exhaust guide from shaking.

20. The microwave oven according to claim 19, wherein the shaking preventing device comprises at least one shaking preventing protrusion formed on the exhaust guide and at least one corresponding shaking preventing hole formed on a wall of the cavity.

21. The microwave oven according to claim 17, wherein the at least one exhaust passage hole inclines downwardly toward the outside.

22. The microwave oven according to claim 17, wherein the exhaust guide is attached to a sub-plate formed at a bottom of the cavity.

23. The microwave oven according to claim 17, further comprising a stirrer fan disposed at a connection passage of the at least one suction hole and the at least one exhaust hole.

24. The microwave oven according to claim 17, wherein at least one of the at least one suction hole or the at least one exhaust hole is formed at a lower side portion of the cavity.

* * * * *